US009802238B2

(12) United States Patent
Norita et al.

(10) Patent No.: US 9,802,238 B2
(45) Date of Patent: Oct. 31, 2017

(54) WARM WORKING METHOD FOR STAINLESS STEEL FOIL AND MOLD FOR WARM WORKING

(71) Applicant: NISSHIN STEEL CO., LTD., Tokyo (JP)

(72) Inventors: Katsunari Norita, Osaka (JP); Norimasa Miura, Osaka (JP)

(73) Assignee: Nisshin Steel Co., Ltd., Tokyo (JP)

( * ) Notice: Subject to any disclaimer, the term of this patent is extended or adjusted under 35 U.S.C. 154(b) by 84 days.

(21) Appl. No.: 14/431,665

(22) PCT Filed: Sep. 26, 2013

(86) PCT No.: PCT/JP2013/076028

§ 371 (c)(1),
(2) Date: Mar. 26, 2015

(87) PCT Pub. No.: WO2014/050955

PCT Pub. Date: Apr. 3, 2014

(65) Prior Publication Data

US 2015/0231683 A1 Aug. 20, 2015

(30) Foreign Application Priority Data

Sep. 28, 2012 (JP) ..... 2012-215865
Sep. 25, 2013 (JP) ..... 2013-198203

(51) Int. Cl.

| | |
|---|---|
| ***B21D 31/00*** | (2006.01) |
| ***B21D 33/00*** | (2006.01) |
| ***C22C 38/18*** | (2006.01) |
| ***B21D 22/20*** | (2006.01) |

(52) U.S. Cl.
CPC ..... *B21D 33/00* (2013.01); *B21D 22/208* (2013.01); *C22C 38/18* (2013.01); *Y10T 29/30* (2015.01); *Y10T 29/301* (2015.01)

(58) Field of Classification Search
CPC ..... B21D 33/00; B21D 22/208; C22C 38/18; Y10T 29/301; Y10T 29/30
See application file for complete search history.

(56) References Cited

FOREIGN PATENT DOCUMENTS

| | | | |
|---|---|---|---|
| CN | 102886422 | A | 1/2013 |
| CN | 103443955 | A | 12/2013 |
| JP | H05 237558 | A | 9/1993 |
| JP | H11-309519 | A | 11/1999 |
| JP | 2005205416 | A | 8/2005 |
| JP | 2009-113058 | A | 5/2009 |
| JP | 2012216511 | A | 11/2012 |
| WO | 2012/132956 | A1 | 10/2012 |

OTHER PUBLICATIONS

Supplementary European Search Report dated May 6, 2016, for corresponding European application EP 13 84 2476, 8 pages.
A communication issued in corresponding Chinese application 201380050840.2 dated Oct. 8, 2015, 6 pages.

*Primary Examiner* — Richard Chang
(74) *Attorney, Agent, or Firm* — Rothwell, Figg, Ernst & Manbeck, P.C.

(57) ABSTRACT

An austenitic stainless steel foil 2 with a thickness equal to or less than 300 μm is disposed to face a punch 12, and the stainless steel foil 2 is subjected to drawing in a state in which an annular region 2*a* of the stainless steel foil 2 that is in contact with a shoulder portion 12*d* of the punch 12 is set to a temperature up to 30° C. and an external region 2*b* outside the annular region 2*a* is set to a temperature of from 40° C. to 100° C.

9 Claims, 3 Drawing Sheets

WARM WORKING METHOD FOR STAINLESS STEEL FOIL AND MOLD FOR WARM WORKING

CROSS REFERENCE TO RELATED APPLICATIONS

This application is a 35 U.S.C. §371 National Phase Entry Application from PCT/JP2013/076028, filed Sep. 26, 2013, and designating the United States, which claims priority under 35 U.S.C. §119 to Japanese Patent Application No. 2012-215865 filed on Sep. 28, 2012, and to Japanese Patent Application No. 2013-198203 filed on Sep. 25, 2013, which are incorporated herein by reference in their entireties.

TECHNICAL FIELD

The present invention relates to a warm working method for stainless steel foil by which stainless steel foil is subjected to drawing, and also relates to a mold for warm working.

BACKGROUND ART

Patent Literature 1 listed hereinbelow discloses an example of a conventional warm working method for a stainless steel foil of this type. Thus, Patent Literature 1 describes cooling a punch to 0° C. to 30° C. and heating a pressure pad to 60° C. to 150° C. when drawing an austenitic stainless steel sheet with a thickness of about 800 μm to 1000 μm.

Patent Literature 1: Japanese Patent Application Publication No. 2009-113058.

DISCLOSURE OF THE INVENTION

The inventors have investigated the application of the drawing such as described in Patent Document 1 to a thin stainless steel foil with a thickness equal to or less than 300 μm and encountered the following problem. Namely, the method described in Patent Document 1 is for working a comparatively thick stainless steel sheet with a thickness of about 800 μm to 1000 μm, and when this method is directly applied to a thin stainless steel foil with a thickness equal to or less than 300 μm, cracks occur and deep drawing sometimes cannot be realized.

The present invention has been created to resolve this problem, and it is an objective of the present invention to provide a warm working method for a stainless steel foil that can suppress the occurrence of cracks and can realize deep drawing more reliably even in the case of a thin stainless steel foil with a thickness equal to or less than 300 μm.

The warm working method for a stainless steel foil according to the present invention includes: disposing an austenitic stainless steel foil with a thickness equal to or less than 300 μm to face a punch and subjecting the stainless steel foil to drawing in a state in which an annular region of the stainless steel foil that is in contact with a shoulder portion of the punch is set to a temperature up to 30° C. and an external region outside the annular region is set to a temperature of from 40° C. to 100° C.

A mold for warm working a stainless steel foil in accordance with the present invention includes: a punch; a blank holder disposed at an outer circumferential position of the punch; and a die disposed to face the blank holder, and serves to subject an austenitic stainless steel foil with a thickness equal to or less than 300 μm to drawing by pressing the stainless steel foil together with the punch inward of the die in a state in which the stainless steel foil is interposed between the blank holder and the die, wherein the punch is provided with cooling means; the blank holder and the die are provided with heating means; and the stainless steel foil is subjected to drawing in a state in which an annular region of the stainless steel foil that is in contact with a shoulder portion of the punch is set to a temperature equal to or less than 30° C. and an external region outside the annular region interposed between the blank holder and the die is set to a temperature of from 40° C. to 100° C.

With the warm working method for a stainless steel foil in accordance with the present invention, the stainless steel foil is subjected to drawing in a state in which the annular region of the stainless steel foil that is in contact with the shoulder portion of the punch is set to a temperature equal to or less than 30° C. and an external region outside the annular region is set to a temperature of from 40° C. to 100° C. or lower. Therefore, the occurrence of cracks can be suppressed and deep drawing can be realized more reliably even in the case of a thin stainless steel foil with a thickness equal to or less than 300 μm.

BEST MODE FOR CARRYING OUT THE INVENTION

Embodiments of the present invention are explained hereinbelow with reference to the appended drawings.

Embodiment 1

Figure 1:
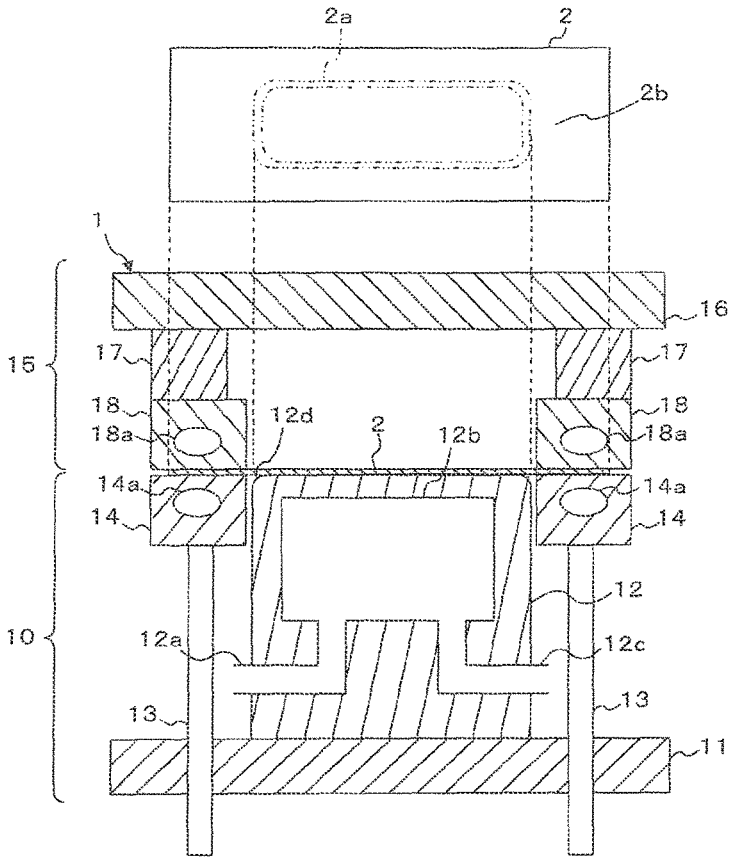
FIG. 1 is a configuration diagram illustrating a mold for warm working that is used for implementing a warm working method for a stainless steel foil according to Embodiment 1 of the present invention.

FIG. 1 is a configuration diagram illustrating a mold 1 for warm working that is used for implementing a warm working method for a stainless steel according to Embodiment 1 of the present invention. As depicted in the figure, the mold 1 for warm working is provided with a lower mold 10 and an upper mold 15 disposed such as to sandwich a stainless steel foil 2. The lower mold 10 is provided with a bed 11, a punch 12 fixed to the bed 11, and a blank holder 14 that is disposed at the outer circumferential position of the punch 12 and coupled to the bed 11 through a cushion pin 13. The upper mold 15 is provided with a slide 16 and a die 18 disposed above the blank holder 14 and fixed to the slide 16 through a spacer 17.

A servo motor (not shown in the figure) is connected to the slide 16. The slide 16, the spacer 17, and the die 18, that is, the upper mold 15, are driven integrally by a drive force from the servo motor in the direction of approaching the lower mold 10 and withdrawing therefrom. After the stainless steel foil 2 has been disposed so as to face the punch 12, the upper mold 15 is shifted in the direction approaching the lower mold 10. As a result, the punch 12 is pressed into the stainless steel foil 2 and the die 18, and the stainless steel foil 2 is subjected to drawing.

The punch 12 is provided with cooling means constituted by an introduction path 12*a* connected to an external coolant system (not shown in the figure), a cooling chamber 12*b* into which a coolant is introduced through the introduction path 12*a*, and a discharge path 12*c* through which the coolant is discharged from the cooling chamber 12*b*. Thus, the punch 12 can be cooled by introducing the coolant into the cooling chamber 12*b*. As a result of bringing such cooled punch 12 into contact with the stainless steel foil 2, the annular region 2*a* of the stainless steel foil 2 which is in contact with a shoulder portion 12*d* of the punch 12 is cooled. The cooling range of the stainless steel foil 2 may include at least the annular region 2*a*, but may include not only the annular region 2*a*, but also an inner region of the annular region 2*a*. The present embodiment is configured such that the stainless steel foil 2 is cooled by the punch 12. Therefore, not only the annular region 2*a*, but also the inner region of the annular region 2*a* is cooled.

A counter punch coupled through a spring or the like to the slide can be disposed at a position facing the punch, and a cooling chamber into which the coolant is introduced can be provided in the counter punch, thereby further increasing the cooling efficiency of the stainless steel foil 2 (this configuration is not shown in the figure).

Heaters 14*a*, 18*a* (heating means) for heating the blank holder 14 and the die 18 are incorporated in the blank holder 14 and the die 18. Since the stainless steel foil 2 is sandwiched by the heated blank holder 14 and die 18, the external region 2*b* of the annular region 2*a* is heated.

The stainless steel foil 2 is an uncoated austenitic stainless steel which is not provided with an additional layer, for example such as a resin layer, on the front or rear surface. A thin foil with a thickness equal to or less than 300 μm is used as the stainless steel foil 2.

A warm working method for the stainless steel foil 2 performed by using the mold 1 for warm working which is depicted in FIG. 1 is described below. When the upper mold 15 is withdrawn from the lower mold 10, the stainless steel foil 2 is placed on the punch 12 and the blank holder 14 so as to face the punch 12, and the upper mold 15 is thereafter lowered to a position in which the stainless steel foil 2 is sandwiched between the blank holder 14 and the die 18. Where the punch 12 is disposed at the upper side and the die 18 is disposed at the lower side, the stainless steel foil 2 is placed on the die 18.

In this case, as a result of cooling the punch 12 and heating the blank holder 14 and the die 18, the annular region 2*a* of the stainless steel foil 2 is at a temperature of from 0° C. to 30° C. and the external region 2*b* of the stainless steel foil 2 is at a temperature of from 40° C. to 100° C., preferably from 60° C. to 80° C.

The annular region 2*a* is set to a temperature of up to 30° C. because where the temperature thereof is higher than 30° C., a sufficient increase in breaking strength caused by the martensitic transformation cannot be obtained. Further, the annular region 2*a* is set to a temperature of 0° C. or higher because where the temperature of the annular region is less than 0° C., frost adheres to the punch 12 or the annular region and moldability of the molded product is lost. In addition, the molded article can collapse as a result of temperature-induced shrinkage at the time of removal from the mold.

The external region 2*b* is set to a temperature of from 40° C. because where the temperature of the external region 2*b* is less than 40° C., the hardening caused by the martensitic transformation cannot be sufficiently suppressed. The external region 2*b* is set to a temperature of up to 100° C. because where the temperature of the external region 2*b* is higher than 100° C., the temperature of the annular region 2*a* rises due to a transfer of heat from the external region 2*b* to the annular region 2*a*, and a sufficient increase in a breaking strength of the punch caused by the martensitic transformation cannot be obtained.

As indicated hereinabove, working at a larger drawing ratio (ratio of the workpiece diameter to the product diameter) can be performed by setting the temperature of the external region 2*b* to from 60° C. to 80° C. The temperature is set to from 60° C. because the effect of suppressing the hardening caused by the martensitic transformation can be demonstrated more reliably, and the temperature is set up to 80° C. because the temperature rise of the annular region 2*a* can be suppressed.

By setting the temperature of the external region 2*b* to from 40° C. to less than 60° C., it is possible to shorten the time required for temperature restoration of the mold 1 for warm working (time required for the temperature of the blank holder 14 and the die 18, which has decreased due to contact with the stainless steel foil 2, to return to a range of from 40° C. to less than 60° C.) and increase the working efficiency while enabling deep drawing.

After the temperatures of the annular region 2*a* and the external region 2*b* have been set to the above-described temperatures, the upper mold 15 is further lowered. As a result, the punch 12 is pressed into the stainless steel foil 2 and the die 18, drawing is implemented, and the stainless steel foil 2 is molded into a hat shape. A lubricating oil is supplied to the punch 12, the die 18, and the stainless steel foil 2 through the entire drawing process.

Figure 2:
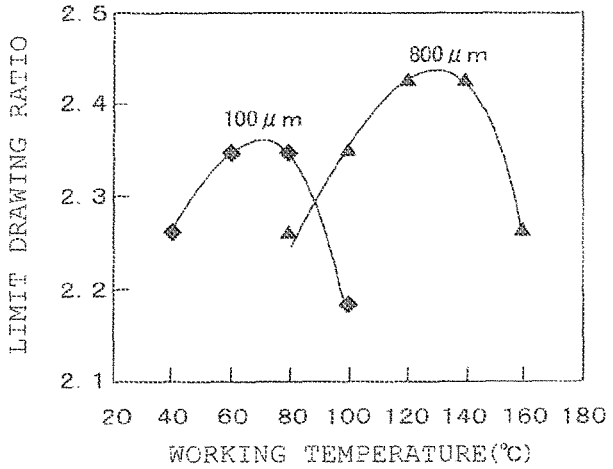
FIG. 2 is a graph illustrating the difference in a limit drawing ratio caused by the difference in a sheet thickness.
Figure 3:
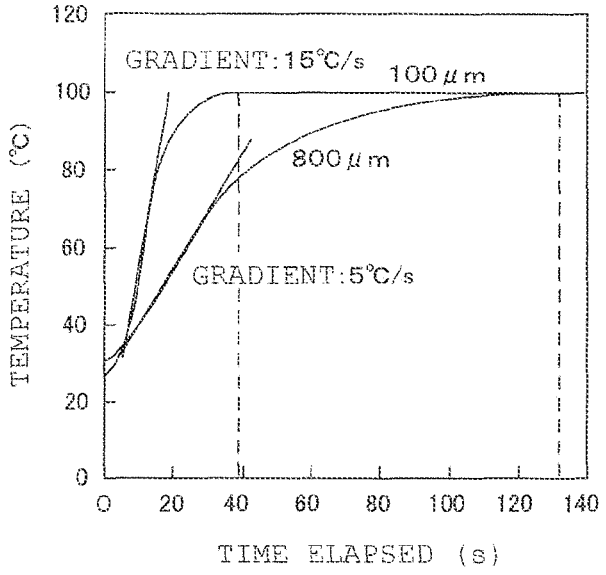
FIG. 3 is a graph illustrating the difference in the increase of temperature caused by the difference in a sheet thickness.
Figure 4:
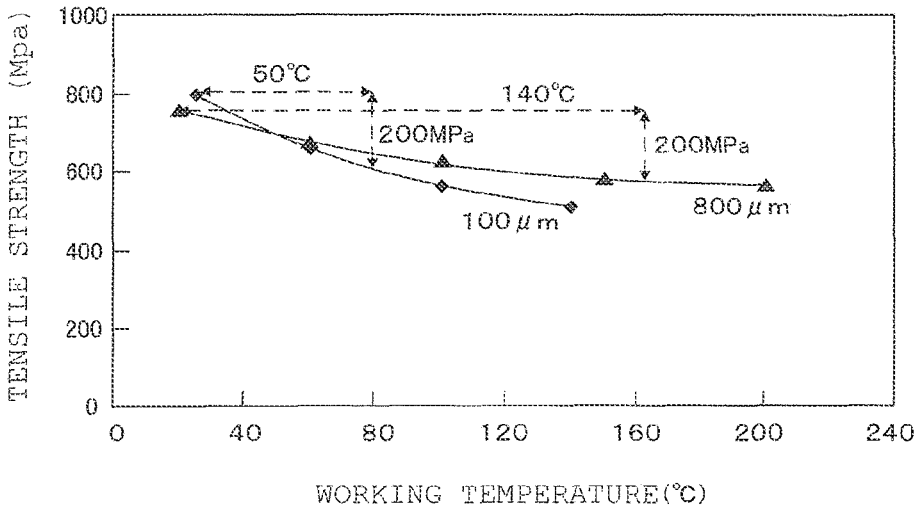
FIG. 4 is a graph illustrating the difference in a tensile strength change caused by the difference in a sheet thickness.

FIG. 2 is a graph illustrating the difference in a limit drawing ratio caused by the difference in sheet thickness. FIG. 3 is a graph illustrating the difference in the increase of temperature caused by the difference in sheet thickness. FIG. 4 is a graph illustrating the difference in a tensile strength change caused by the difference in sheet thickness.

As an example, the inventors performed drawing of the stainless steel foil 2 with a thickness of 100 μm. As a comparative example, a stainless steel sheet with a thickness of 800 μm was subjected to drawing. The temperature of the external region 2*b* (the blank holder 14 and the die 18) was changed from 40° C. to 120° C. while changing the diameter of the stainless steel foil 2 and the stainless steel sheet, and the limit drawing ratio (ratio of the workpiece diameter to the product diameter) at which no cracks occurred was examined. The diameter of the punch 12 was 40.0 mm, the punch shoulder R was 2.5 mm, the inner diameter of the die 18 was 40.4 mm, the die shoulder R was 2.0 mm, and the temperature of the annular region 2*a* (punch 12) was 10° C. to 20° C.

As depicted in FIG. 2, it was determined that in the case of the stainless steel foil 2 with a thickness of 100 μm, sufficient deep drawing could be realized by setting the temperature of the external region 2*b* to from 40° C. to 100° C. In particular, it was determined that drawing at a larger drawing ratio could be performed by setting the temperature of the external region 2*b* to from 60° C. to 80° C.

Meanwhile, in the case of the stainless steel plate with a thickness of 800 μm, it was necessary to set the temperature of the external region 2*b* to from 80° C. to 160° C. in order to perform the deep drawing similar to that of the above-described stainless steel foil 2 with a thickness of 100 μm. Thus, it was determined that the optimum working temperature of the stainless steel foil 2 with a thickness of 100 μm had shifted to the low-temperature side with respect to the optimum working temperature of the stainless steel sheet with a thickness of 800 μm. This comparison confirmed that deep drawing cannot be realized by simple application of the method for working a stainless steel sheet with a thickness of 800 μm to a stainless steel foil 2 with a thickness of 100 μm.

The following reason can be suggested for explaining the shift of the optimum working temperature to the low-temperature side. Specifically, as depicted in FIG. 3, thermal conductivity of a stainless steel foil 2 with a thickness of 100 μm is higher than that of a stainless steel sheet with a thickness of 800 μm. In other words, in a stainless steel foil 2 with a thickness of 100 μm, the heat of the external region 2*b* is easier transferred to the annular region 2*a*. Therefore, where the temperature of the external region 2*b* in a stainless steel foil 2 with a thickness of 100 μm becomes too high, the temperature of the annular region 2*a* increases and a sufficient increase in the breaking strength caused by the martensitic transformation cannot be obtained. As a consequence, the workability of a stainless steel foil 2 with a thickness of 100 μm is degraded unless the temperature is lower than that of the stainless steel sheet with a thickness of 800 μm, which is apparently why the optimum working temperature shifts to a low-temperature side.

Further, where the tensile strength change of a stainless steel foil 2 depicted in FIG. 4 is compared with that of a stainless steel sheet, it can be found that the tensile strength change in a low-temperature region of the stainless steel foil is higher. Therefore, in the case of a stainless steel foil 2 with a thickness of 100 μm, a difference in strength similar to that in a stainless steel sheet with a thickness of 800 μm can be obtained at a heating amount which is half or less that in the case of a stainless steel sheet with a thickness of 800 μm. Thus, since a stainless steel foil 2 with a thickness of 100 μm can be softened at a temperature lower than that of a stainless steel sheet with a thickness of 800 μm, the optimum working temperature shifts to a low-temperature side.

In the explanation using FIGS. 2 and 3, a stainless steel foil 2 with a thickness of 100 μm is considered, but sufficient deep drawing can be realized in the same temperature region with any stainless steel foil 2 with a thickness equal to or less than 300 μm. This is because in a stainless steel foil 2 with a thickness equal to or less than 300 μm, the degree of thermal effect produced on the tensile strength change demonstrates the same trend as in a stainless steel foil 2 with a thickness of 100 μm. Sufficient deep drawing can also be realized in the same temperature region even with a very thin stainless steel foil 2 with a thickness equal to or less than 5 μm, provided that such foil can be worked with the mold 1 for warm working.

With such a warm working method and mold 1 for warm working of a stainless steel foil 2, a stainless steel foil 2 is subjected to drawing in a state in which the annular region 2*a* of the stainless steel foil 2 that is in contact with the shoulder portion 12*d* of the punch 12 is set to a temperature up to 30° C. and the external region 2*b* of the annular region 2*a* is set to a temperature of from 40° C. to 100° C. Therefore, the occurrence of cracking can be suppressed and deep drawing can be realized more reliably even with respect to a thin stainless steel foil with a thickness equal to or less than 300 μm. Such a warm working method is particularly useful, for example, for the production of containers such as battery covers that have to combine high strength with reduced weight.

Further, where the temperature of the external region 2*b* is set to from 60° C. to 80° C. when the stainless steel foil 2 is subjected to drawing, the working can be performed at a higher drawing ratio.

Furthermore, where the temperature of the external region 2*b* is set to from 40° C. to less than 60° C. when the stainless steel foil 2 is subjected to drawing, it is possible to shorten the time required for temperature restoration of the mold 1 for warm working and increase the working efficiency while realizing deep drawing.

Embodiment 2

Figure 5:
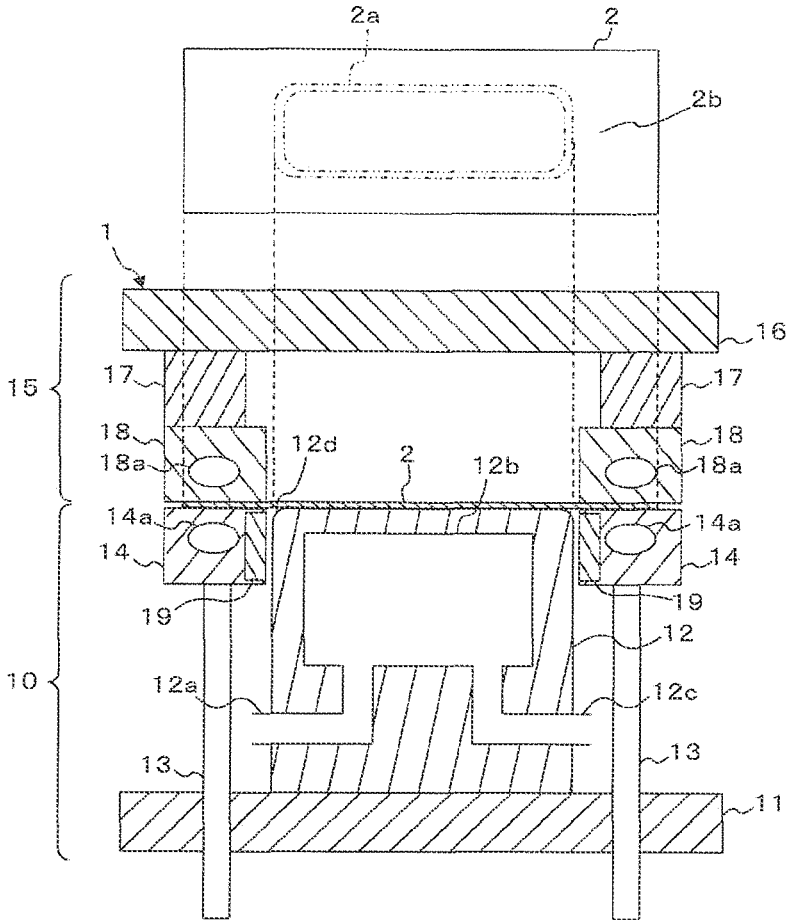
FIG. 5 is a configuration diagram illustrating a mold for warm working that is used for implementing a warm working method for a stainless steel foil according to Embodiment 2 of the present invention.

FIG. 5 is a configuration diagram illustrating the mold 1 for warm working that is used for implementing a warm working method for a stainless steel foil according to Embodiment 2 of the present invention. As depicted in FIG. 5, in the mold 1 for warm working according to Embodiment 2, a thermally insulating plate 19 (thermally insulating member) constituted by glass fibers as a main base material and a borate binder as a main material is provided at the inner circumferential portion of the blank holder 14 facing the outer circumferential surface of the punch 12. Other features are the same as in Embodiment 1.

Figure 6:
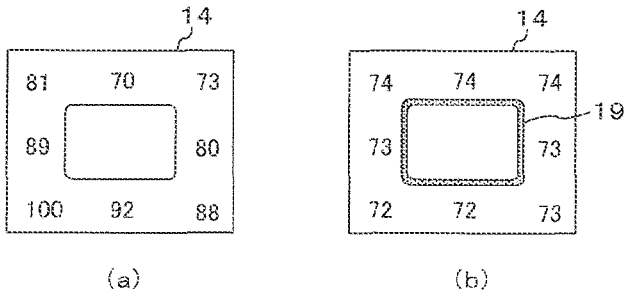
FIG. 6 is an explanatory drawing illustrating the difference in temperature distribution of a blank holder caused by the presence of a thermally insulating plate.

FIG. 6 is an explanatory drawing illustrating the difference in temperature distribution of the blank holder 14 caused by the presence of the thermally insulating plate 19. Thus, FIG. 6(*a*) depicts the temperature distribution obtained when the thermally insulating plate 19 is not provided, and FIG. 6(*b*) depicts the temperature distribution obtained when the thermally insulating plate 19 is provided. FIGS. 6(*a*) and 6(*b*) each represent the results obtained by measuring the surface temperature of the blank holder 14 with a contact thermometer after the blank holder was allowed to stay for 30 min at a set temperature of 70° C.

In the configuration which is not provided with the thermally insulating plate 19, as depicted in FIG. 6(*a*), the deviation of the surface temperature of the blank holder 14 reaches 30° C. at maximum. A low temperature in the upper portion depicted in the figure is due to the presence of a lead-out portion of a control thermocouple or heater 14*a* in this portion. Meanwhile, in the configuration which is provided with the thermally insulating plate 19 at the inner circumferential portion of blank holder 14, as depicted in FIG. 6(*b*), the temperature distribution is greatly reduced. This is apparently because the presence of the thermally insulating plate 19 at the inner circumferential portion prevents the heat of the heater 14*a* from escaping to the central hole (hole for inserting the punch 12) of the blank holder 14 and the heat of the heater 14*a* spreads uniformly over the entire blank holder 14. This temperature distribution indicates that the heat of the blank holder 14 is unlikely to be transferred to the punch 12 due to the presence of the thermally insulating plate 19 at the inner circumferential portion of the blank holder 14.

An example is explained hereinbelow. The inventors continuously implemented at 30-sec intervals the drawing of stainless steel foils 2 with a thickness of 100 μm by using the mold 1 for warm working (with the thermally insulated structure) depicted in FIG. 5 and the mold 1 for warm working (without a thermally insulated structure) depicted in FIG. 1. In the continuous drawing, the set temperature of the external region 2*b* (blank holder 14 and die 18) was 70° C. and the set temperature of the annular region 2*a* (punch 12) was 10° C. to 20° C. The possibility of continuous press working was then investigated. The results are shown in Table 1 below.

The working shape was an angular tubular shape with a molding height of 40 mm, the punch 12 had a shape of 99.64×149.64 mm, the punch shoulder R was 3.0 mm, the punch corner R was 4.82 mm, the die 18 had a shape of 100×150 mm, the die shoulder R was 3.0 mm, and the die corner R was 5.0 mm.

TABLE 1

| | | With thermally insulated structure | Without thermally insulated structure |
|---|---|---|---|
| Number of times | 1 | ○ | ○ |
| | 2 | ○ | ○ |
| | 3 | ○ | ○ |
| | 4 | ○ | x |
| | 5 | ○ | — |
| | 6 | ○ | — |
| | 7 | ○ | — |
| | 8 | ○ | — |
| | 9 | ○ | — |
| | 10 | ○ | — |

As shown in Table 1, where the results of continuous press working obtained with the mold 1 for warm working (with a thermally insulated structure) depicted in FIG. 5 and the mold 1 for warm working (without a thermally insulated structure) depicted in FIG. 1 are compared, the number of possible continuous pressing operations with the former mold is larger than that with the latter mold. This is apparently because the presence of the thermally insulating plate 19 on the inner circumferential portion of the blank holder 14 makes it possible to avoid increases in the temperature of the punch 12 caused by the heat of the blank holder 14 and maintain a more adequate relationship between the temperatures of the annular region 2*a* and the external region 2*b*. When the temperature of the punch 12 was measured before and after the continuous pressing, the temperature change was less and the temperature was more stable with the mold 1 for warm working (with a thermally insulated structure) depicted in FIG. 5.

With such warm working method and mold 1 for warm working of the stainless steel foil 2, since the thermally insulating plate 19 is provided at the inner circumferential portion of the blank holder 14, the increase in the temperature of the punch 12 caused by the heat of the blank holder 14 can be avoided and continuous drawing can be performed more reliably in a short interval of time.

The invention claimed is:

1. A warm working method for an austenitic stainless steel foil, the method comprising:

disposing the austenitic stainless steel foil with a thickness equal to or less than 300 μm to face a punch, subjecting the austenitic stainless steel foil to a draw, wherein an annular region of the austenitic stainless steel foil that is in contact with a shoulder portion of the punch is set to a temperature up to 30° C. and an external region of the austenitic stainless steel foil that is outside the annular region is set to a temperature of from 40° C. to 100° C., restricting the external region by using a blank holder disposed at an outer circumferential position of the punch when the austenitic stainless steel foil is subjected to the draw, and wherein a heater for heating the external region is provided inside the blank holder.

2. The warm working method for the austenitic stainless steel foil according to claim 1, wherein the temperature of the external region is set to from 60° C. to 80° C. when the austenitic stainless steel foil is subjected to the draw.

3. The warm working method for the austenitic stainless steel foil according to claim 1, wherein the temperature of the external region is set to from 40° C. to less than 60° C. when the austenitic stainless steel foil is subjected to the draw.

4. The warm working method for the austenitic stainless steel foil according to claim 1 further comprising a thermally insulating member provided at an inner circumferential portion of the blank holder facing the outer circumferential surface of the punch.

5. A warm working method for an austenitic stainless steel foil, the method comprising:

disposing the austenitic stainless steel foil with a thickness equal to or less than 300 μm to face a punch, and subjecting the stainless steel foil to a draw, wherein an annular region of the stainless steel foil that is in contact with a shoulder portion of the punch is set to a temperature up to 30° C. and an external region of the stainless steel foil that is outside the annular region is set to a temperature of from 40° C. to less than 60° C.

6. A mold for warm working a stainless steel foil, the mold comprising:

a punch;

a blank holder disposed at an outer circumferential position of the punch; and a die disposed to face the blank holder, and where the mold serving to subject an austenitic stainless steel foil with a thickness equal to or less than 300 μm to drawing by pressing the stainless steel foil together with the punch inward of the die in a state in which the stainless steel foil is interposed between the blank holder and the die, wherein the punch is provided with cooling means, the blank holder and the die are provided with heating means, and the stainless steel foil is subjected to drawing in a state in which an annular region of the stainless steel foil that is in contact with a shoulder portion of the punch is set to a temperature equal up to 30° C. and an external region outside the annular region interposed between the blank holder and the die is set to a temperature of from 40° C. to 100° C., wherein a thermally insulating member is provided at an inner circumferential portion of the blank holder facing the outer circumferential surface of the punch.

7. A warm working method for an austenitic stainless steel foil, the method comprising:

disposing the austenitic stainless steel foil with a thickness equal to or less than 300 μm to face a punch, subjecting the austenitic stainless steel foil to a draw, wherein an annular region of the austenitic stainless steel foil that is in contact with a shoulder portion of the punch is set to a temperature up to 30° C. and an external region of the austenitic stainless steel foil that is outside the annular region is set to a temperature of from 40° C. to 100° C., restricting the external region by using a blank holder disposed at an outer circumferential position of the punch when the austenitic stainless steel foil is subjected to the draw, and wherein a heater for heating the external region is provided inside the blank holder, and a thermally insulating member provided at an inner circumferential portion of the blank holder facing the outer circumferential surface of the punch.

8. The warm working method for the austenitic stainless steel foil according to claim 7, wherein the temperature of the external region is set to from 60° C. to 80° C. when the austenitic stainless steel foil is subjected to the draw.

9. The warm working method for the austenitic stainless steel foil according to claim 7, wherein the temperature of the external region is set to from 40° C. to less than 60° C. when the austenitic stainless steel foil is subjected to the draw.

* * * * *